US006494177B2

(12) United States Patent
Fuoss et al.

(10) Patent No.: US 6,494,177 B2
(45) Date of Patent: Dec. 17, 2002

(54) OIL-PUMP DRIVE FOR AN INTERNAL-COMBUSTION ENGINE

(75) Inventors: Klaus Fuoss, Balingen (DE); Stefan Fegg, Korntal-Muenchingen (DE)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/809,723

(22) Filed: Mar. 15, 2001

(65) Prior Publication Data

US 2001/0035307 A1 Nov. 1, 2001

(30) Foreign Application Priority Data

Mar. 16, 2000 (DE) ..... 100 12 892

(51) Int. Cl.[7] ..... F01M 1/02
(52) U.S. Cl. ..... 123/196 R; 180/219
(58) Field of Search ..... 123/196 R; 180/219

(56) References Cited

U.S. PATENT DOCUMENTS 5,031,725 A 7/1991 Millar
6,116,205 A * 9/2000 Troxier et al. ..... 123/196 R

FOREIGN PATENT DOCUMENTS

| | | | |
|---|---|---|---|
| DE | 7828621 | U1 | 2/1979 |
| DE | 3228889 | A1 | 2/1984 |
| DE | 3544110 | A1 | 6/1987 |
| DE | 3511186 | C2 | 5/1988 |
| EP | 0451684 | A1 | 10/1991 |
| JP | 05059924 | A | 3/1993 |
| JP | 10196336 | A | 7/1998 |

* cited by examiner

*Primary Examiner*—Tony M. Argenbright
*Assistant Examiner*—Katrina B. Harris
(74) *Attorney, Agent, or Firm*—Michael Best & Friedrich, LLP

(57) ABSTRACT

An oil-pump drive for an internal-combustion engine, in particular for a motorcycle. The drive includes an oil pump, in the housing of which is arranged at least one rotor member for supplying a volumetric flow of oil, wherein the rotor is driven via the crankshaft of the internal-combustion engine. It is proposed that the rotor of the oil pump is connected to a shaft driven directly by the crankshaft. In this way, the oil pump is directly driven in a simple manner.

20 Claims, 6 Drawing Sheets

OIL-PUMP DRIVE FOR AN INTERNAL-COMBUSTION ENGINE

FIELD OF THE INVENTION

This invention relates to an oil-pump drive for an internal-combustion engine and a method of making an oil-pump drive for an internal combustion engine, in particular for a motorcycle.

BACKGROUND OF THE INVENTION

It is known from the prior art to ensure the oil supply in an internal-combustion engine by means of gear pumps (see e.g. EP 0 451 684 A1) or internally-geared rotor pumps. It is also known to drive such oil pumps indirectly via the crankshaft using a chain or gear transmission. However, these arrangements are expensive because they require corresponding transmission members, require additional installation space, and play an important role in noise generation. Furthermore, internally-geared rotor-pump arrangements are known in which the inner rotor is pressed onto the crankshaft and is mounted in the oil-pump housing together with the outer rotor.

SUMMARY OF THE INVENTION

The present invention provides an improved motorcycle engine having a crankshaft, an oil pump coupled for rotation with the crankshaft, and a primary gear positioned between the oil pump and the crankshaft. Because the rotor of the oil pump is driven directly by a shaft via the crankshaft, additional drive components such as chains, gears and the like can be dispensed with.

In one embodiment of the present invention, a particularly simple and inexpensive connection of the oil-pump rotor to the crankshaft can be achieved if a gear arranged on the crankshaft collar has a central opening into which the shaft of the oil pump is inserted in a rotationally fixed manner. A simple positive connection between the gear and the rotor shaft can be achieved if the inserted end of the shaft and the opening in the gear are square. In alternative embodiments of the present invention, this same positive connection can be achieved by inserting a shaft having any other shape that can transmit torque into a similarly shaped opening in the primary gear.

In the first preferred embodiment of the present invention, the gear arranged on the crankshaft collar is advantageously fixed thereto by fasteners (for example bolts, screws, pins, and the like) arranged radially around the central opening, the gear simultaneously being usable as a drive for an intermediate shaft and a coupling. However, in a second preferred embodiment, the primary gear is integral with the crankshaft collar, thus eliminating the need for fasteners.

The oil pump is advantageously formed as an internally-geared rotor pump in which the inner rotor is driven by the shaft inserted into the gear of the crankshaft. Further advantageous embodiments and improvements of the oil-pump drive according to the invention for an internal-combustion engine are described below.

BRIEF DESCRIPTION OF THE DRAWINGS

The present invention is further described with reference to the accompanying drawings, which show preferred embodiments of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit an scope of the present invention.

In the drawings, wherein like reference numerals indicate like parts.

DETAILED DESCRIPTION OF THE ILLUSTRATED EMBODIMENTS

Figure 1:
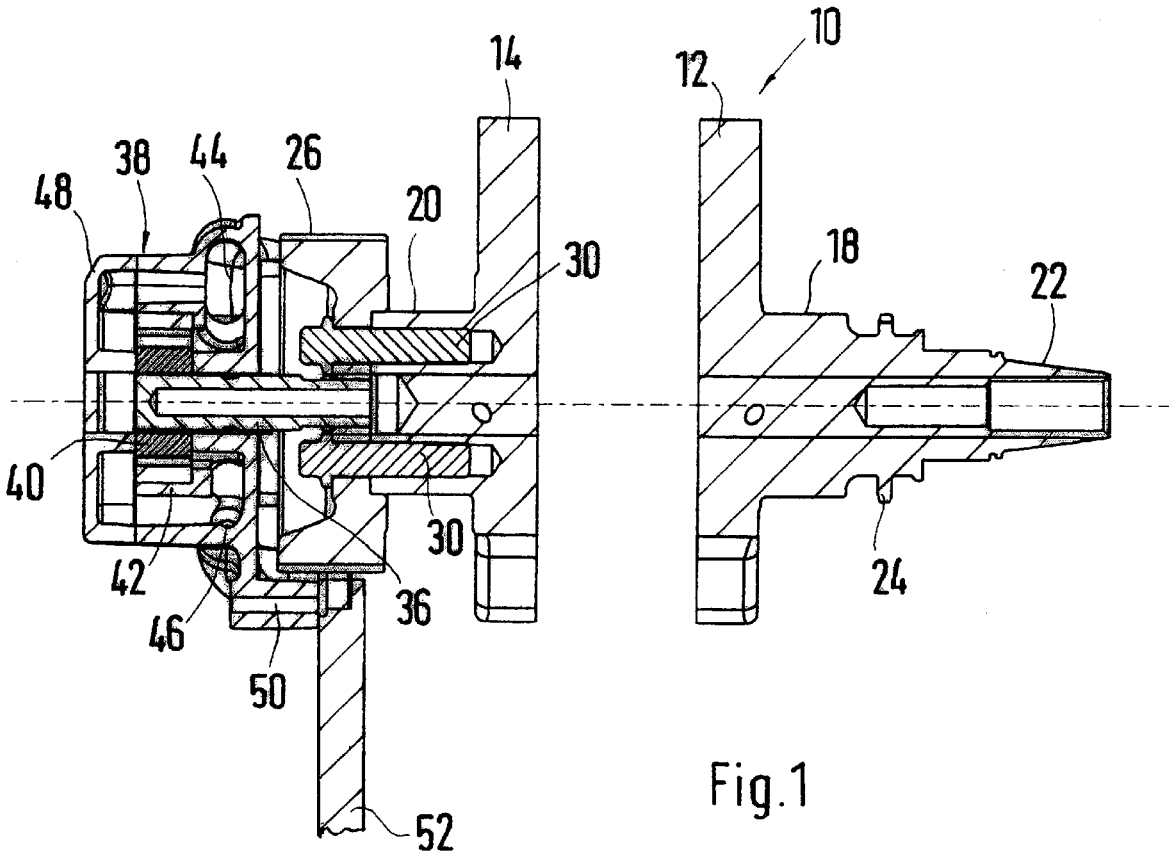
FIG. 1 is a side view of the oil pump, the primary gear, and the crankshaft.
Figure 5:
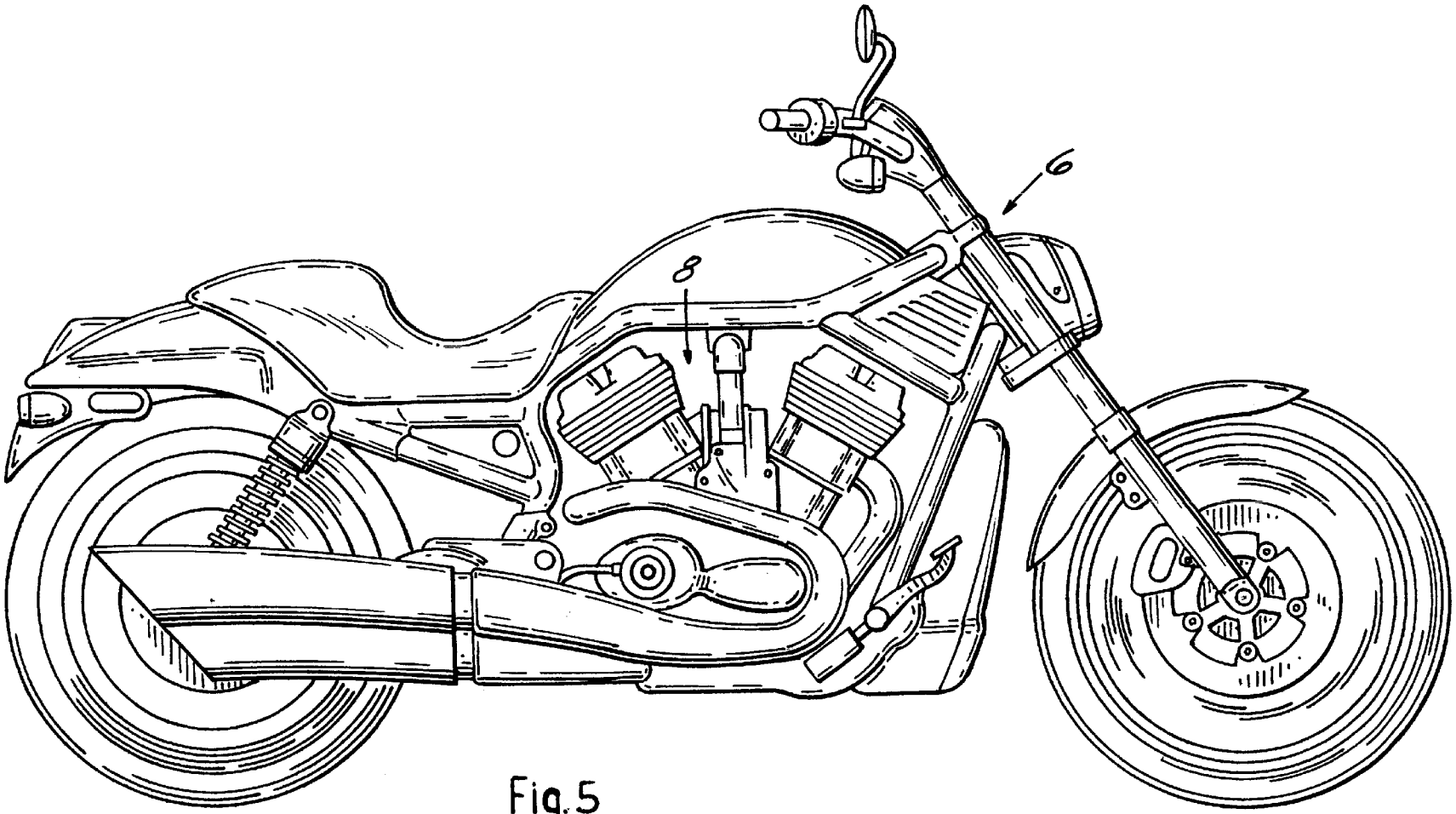
FIG. 5 is right side view of a motorcycle.
Figure 6:
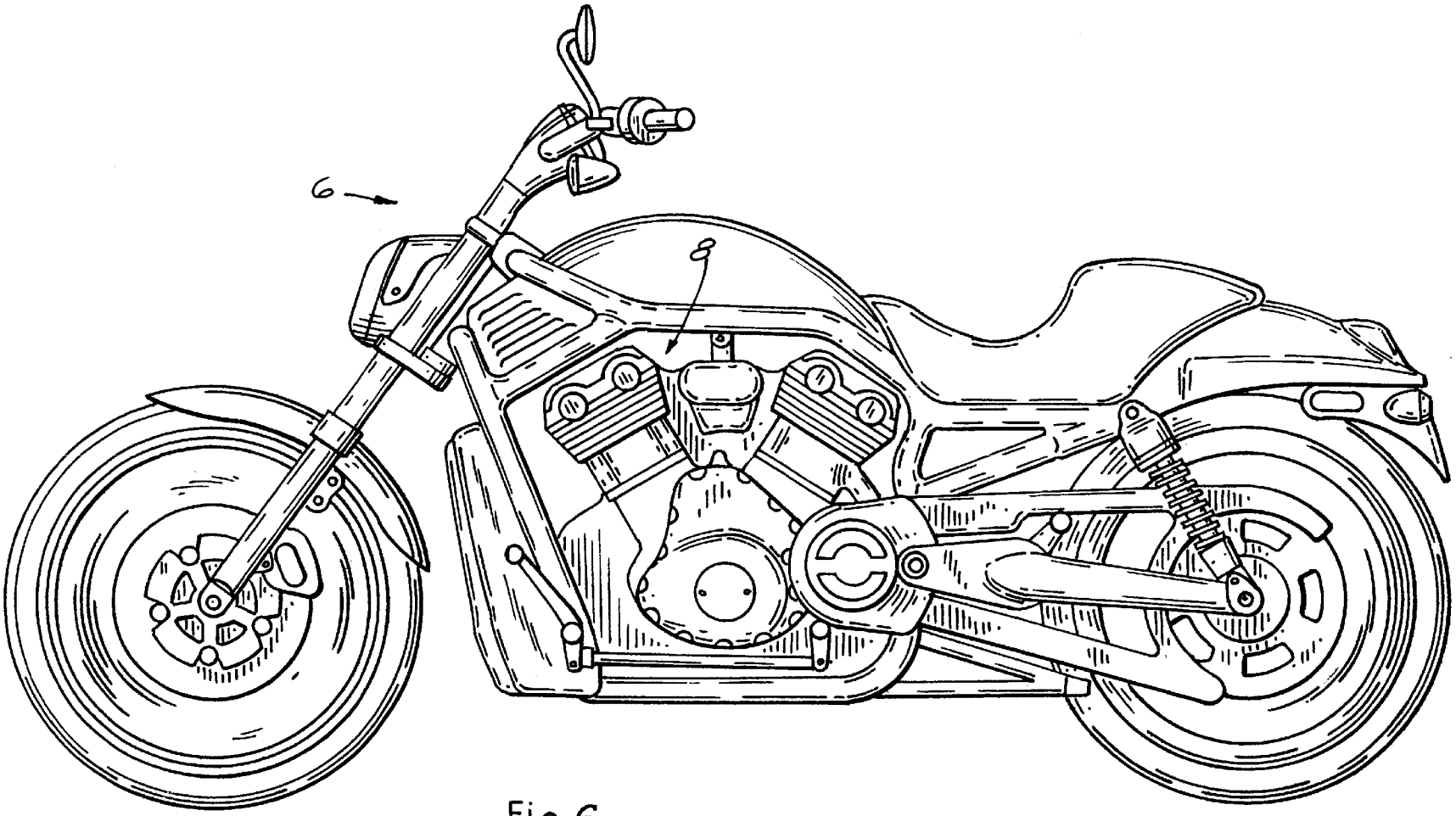
FIG. 6 is a left side view of a motorcycle.

Referring first to FIGS. 5–6, the present invention relates to oil pumps for motorcycles 6 and particularly to motorcycle internal-combustion engines 8. With reference to FIG. 1, the crankshaft 10, formed for a V2 engine, comprises two crankshaft webs 12 and 14, a crankshaft journal 16 on which the connecting rods connected to the two pistons are mounted, two bearing journals 18 and 20 which rotate in the main bearings of the crankcase, a front crankshaft journal 22 on which is mounted e.g. a rotor (not shown) of a dynamo, and a pinion 24 arranged between the bearing journal 18 and the front crankshaft journal 22 and acting as a drive or control means for camshafts (now shown).

Figure 2:
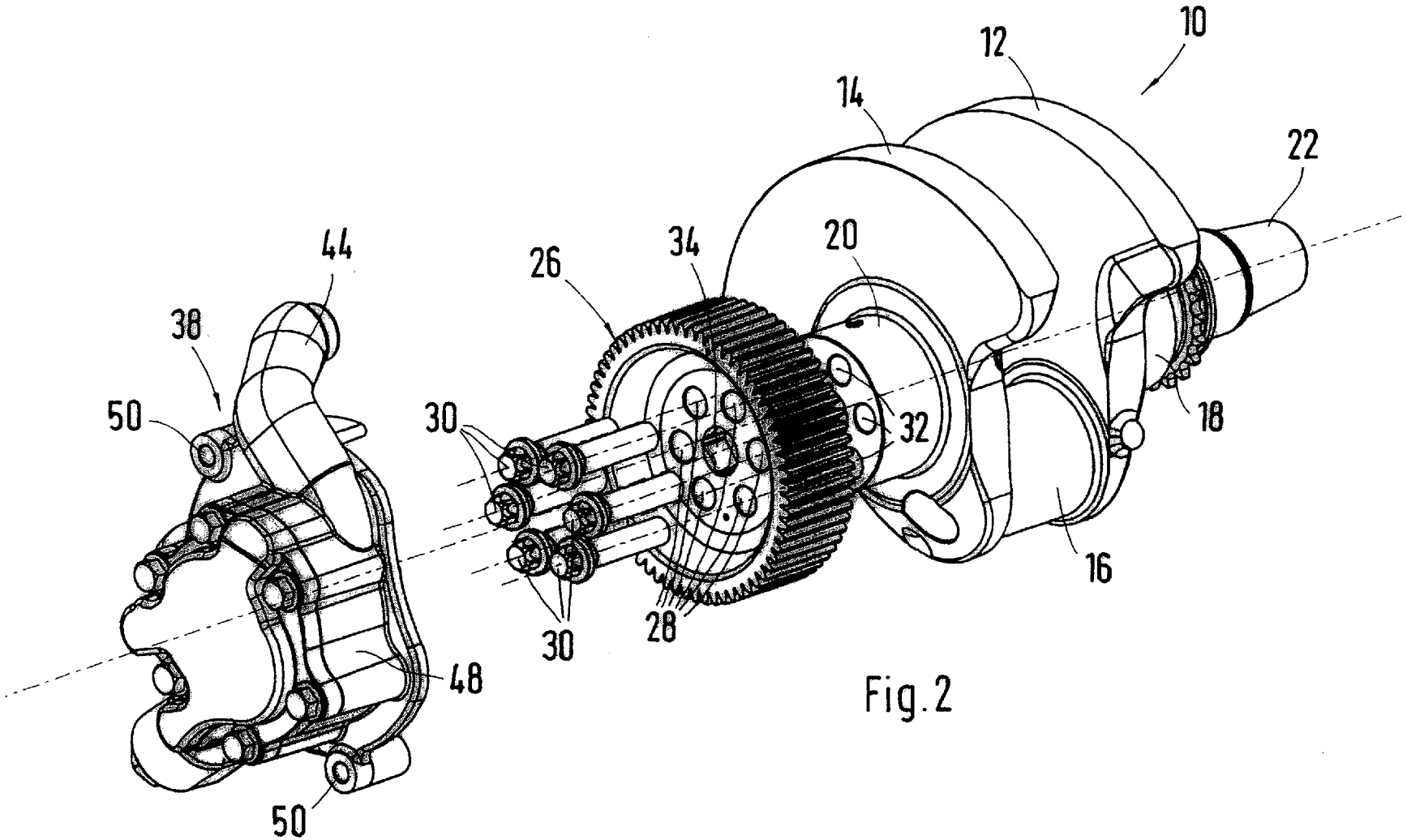
FIG. 2 is an exploded perspective view of the oil pump, the primary gear, and the crankshaft.
Figure 3:
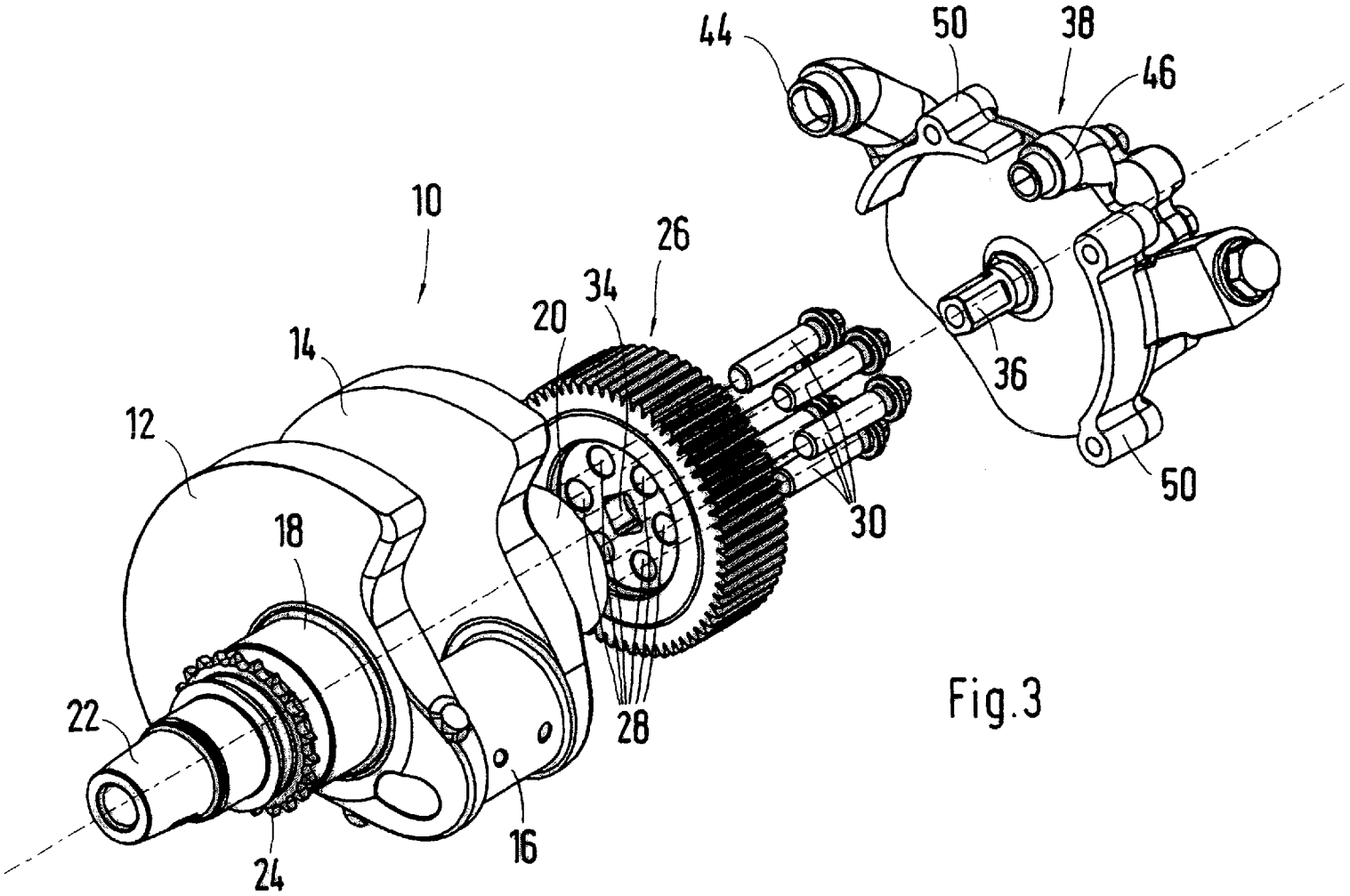
FIG. 3 is an exploded perspective view of the oil pump, the primary gear, and the crankshaft.

The bearing journal 20 is simultaneously formed as a crankshaft collar for a primary gear 26. In one embodiment of the present invention, as shown in FIGS. 1–3, the primary gear 26 has six through holes 28 that are arranged in a circle and through which fasteners 30 are inserted and screwed into holes 32 provided on the end of the crankshaft collar 20. The fasteners 30 can be threaded bolts, screws, pressure fit keys, or any other fasteners known or used in the art of motorcycle construction. Similarly, in other embodiments of the present invention more or less than six fasteners 30 may be used.

Figure 4:
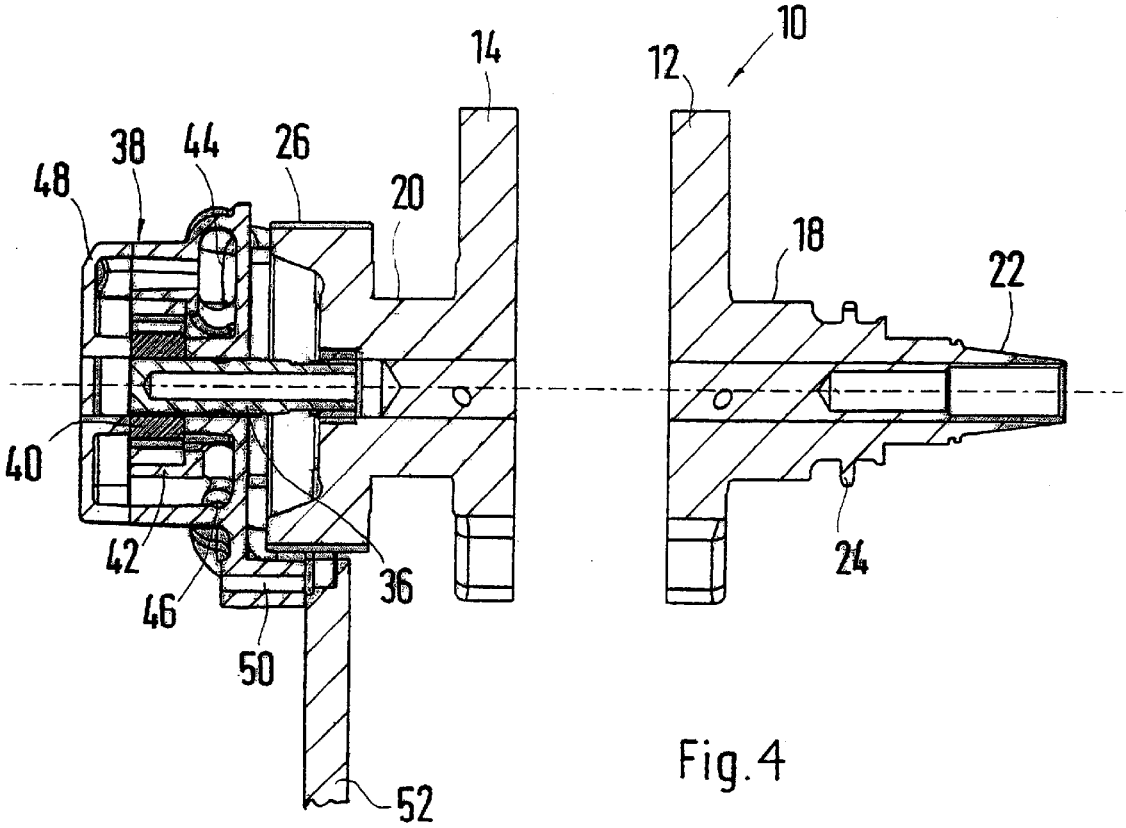
FIG. 4 is a side view of the oil pump according to a second preferred embodiment of the present invention, wherein the primary gear is integral with the crankshaft.

With reference to FIG. 4, in a second embodiment, the primary gear 26 is formed integrally with the bearing journal 20. In this embodiment, no fasteners 30 are necessary. Instead, the bearing journal 20 and the primary gear 26 are machined from a single piece of material. Alternatively, the primary gear 26 can be welded to the bearing journal 20 prior to the assembly of the crankshaft 10.

In a third embodiment of the present invention, the primary gear 26 is mounted on the bearing journal 20 with a pressure fit. In this embodiment, the primary gear 26 is provided with a central opening 34 which is machined to a close tolerance. The bearing journal 20 is preferably machined to a close tolerance which is slightly larger than the central opening 34 of the primary gear 26. The primary gear 26 is then pressed onto the crankshaft 22 at the bearing journal 20. In still another embodiment of the present invention, a key or other similar fastener 30 may be used to help secure the primary gear 26 to the crankshaft 22.

In the embodiment of the present invention shown in FIGS. 1–3 the primary gear 26 has a square opening 34 arranged centrally in its flange surface and into which a rotor shaft 36 of an oil pump 38 is inserted. The end of the rotor shaft 36 inserted into the square opening is also square, thus producing a positive connection between the primary gear 26 and the rotor shaft 36. The oil pump 38 is formed as an internally-geared rotor pump in which an inner rotor 40 is connected to the rotor shaft 36 in a rotationally fixed manner. The inner rotor 40 meshes with an outer rotor 42 which has one tooth more. The rotors have different rotation axes and so the intermediate spaces change during rotation, as a result of which lubricating oil is drawn in via a suction pipe 44 and discharged under pressure via an outlet pipe 46. The oil-pump housing 48 has fixing flanges 50 which serve to fix the oil pump 38 to the crankcase 52, only shown schematically.

In alternative embodiments of the present invention, the bearing journal 20 and the corresponding central opening 34 in the primary gear 26 can be any shape including round, pentagonal, D-shaped, hexagonal, or any other shape that can transmit torque. This produces a positive locking connection between the rotor shaft 36 and the primary gear 26.

The embodiments described above and illustrated in the drawings are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention as set forth in the appended claims.

For example, while various elements and assemblies of the present invention are described as being used with a V2 engine, one having ordinary skill in the art will appreciate that the present invention can also be used with other types of V2 and V3 engines. As such, the functions of the various elements and assemblies of the present invention can be changed to a significant degree without departing from the spirit and scope of the present invention.

What is claimed is:

1. A motorcycle comprising:

a front wheel;

a rear wheel;

a frame supported by the wheels; and an engine supported by the frame, the engine including:

a crankshaft defining a longitudinal axis;

a gear coaxially coupled to the crankshaft, the gear providing power to move the motorcycle; and an oil pump having a pump shaft coaxial with the crankshaft, the pump shaft being coupled for rotation with the crankshaft, wherein the gear is positioned between the oil pump and the crankshaft.

2. A crankshaft as claimed in claim 1, further comprising a fastener coupling the gear to the crankshaft.

3. A crankshaft as claimed in claim 1, wherein the gear is integral with the crankshaft.

4. A crankshaft as claimed in claim 1, wherein the gear includes a central aperture and wherein the oil pump shaft is positioned in the central aperture so that rotation of the gear causes rotation of the oil pump shaft.

5. A crankshaft as claimed in claim 4, wherein the central aperture has a flat surface parallel to the longitudinal axis.

6. A crankshaft as claimed in claim 4, wherein the central aperture is square.

7. A motorcycle engine comprising:

a crankshaft defining a longitudinal axis;

a gear coaxially coupled to the crankshaft, the gear configured to provide power to move a motorcycle; and an oil pump having a pump shaft coaxial with the crankshaft, the pump shaft being coupled for rotation with the crankshaft, wherein the gear is positioned between the oil pump and the crankshaft.

8. A crankshaft as claimed in claim 7, further comprising a fastener coupling the gear to the crankshaft.

9. A crankshaft as claimed in claim 7, wherein the gear is integral with the crankshaft.

10. A crankshaft as claimed in claim 7, wherein the gear includes a central aperture, and wherein the oil pump shaft is positioned in the central aperture so that rotation of the gear causes rotation of the oil pump shaft.

11. A crankshaft as claimed in claim 10, wherein the central aperture is square.

12. A crankshaft as claimed in claim 10, wherein the central aperture has a flat surface parallel to the longitudinal axis.

13. A crankshaft assembly for an internal combustion engine, the crankshaft assembly comprising:

a crankshaft defining a longitudinal axis;

a gear adjacent an end of the crankshaft, the longitudinal axis extending through the gear, a face of the gear coupled to the crankshaft, and the gear configured to provide power to move a motorcycle;

a web on the crankshaft, the web rotatable about the longitudinal axis;

a journal at an end of the crankshaft and along the longitudinal axis; and an oil pump shaft along the longitudinal axis, the oil pump shaft coupled to the gear.

14. A crankshaft as claimed in claim 13, further comprising a fastener received by the gear and the crankshaft such that the crankshaft is coupled to the gear.

15. A crankshaft as claimed in claim 13, wherein the gear is integral with the crankshaft.

16. A crankshaft as claimed in claim 15, further comprising a central aperture in the gear adapted to receive the oil pump shaft.

17. A crankshaft as claimed in claim 14, wherein the central aperture has a flat surface parallel to the longitudinal axis.

18. A method of assembling an internal combustion engine, the engine having a crankshaft defining a longitudinal axis, an oil pump having an oil pump shaft, and a gear having a central aperture, the method comprising:

coupling the gear to an end of the crankshaft;

aligning the oil pump shaft with the central aperture of the gear; and inserting the oil pump shaft into the central aperture from a side of the gear opposite the end of the crankshaft such that the gear is positioned between the crankshaft and the oil pump, and rotation of the crankshaft causes rotation of the pump shaft.

19. The method as claimed in claim 18, wherein coupling the gear to an end of the crankshaft includes passing a fastener through the gear and into the end of the crankshaft.

20. The method as claimed in claim 18, wherein the oil pump shaft includes a flat surface and the central aperture includes a flat surface, and wherein aligning the oil pump shaft with the central aperture includes aligning the respective flat surfaces.

* * * * *